US006655546B1

(12) United States Patent
Bolton et al.

(10) Patent No.: US 6,655,546 B1
(45) Date of Patent: Dec. 2, 2003

(54) PRE-FORMED BAG DISPENSER AND BAGS THEREFOR

(75) Inventors: Simon M. Bolton, Bury (GB); Alexander J. Williams, Bury (GB); Afzal Majid, Birmingham (GB)

(73) Assignee: Euro Packaging PLC, Birmingham (GB)

( * ) Notice: Subject to any disclaimer, the term of this patent is extended or adjusted under 35 U.S.C. 154(b) by 0 days.

(21) Appl. No.: 09/581,726

(22) PCT Filed: Dec. 15, 1998

(86) PCT No.: PCT/GB98/03763

§ 371 (c)(1), (2), (4) Date: Nov. 21, 2001

(87) PCT Pub. No.: WO99/30985

PCT Pub. Date: Jun. 24, 1999

(30) Foreign Application Priority Data

| | | |
|---|---|---|
| Dec. 16, 1997 | (GB) | 9726464 |
| Mar. 25, 1998 | (GB) | 9806242 |
| Mar. 27, 1998 | (GB) | 9806484 |
| Apr. 4, 1998 | (GB) | 9807210 |
| Nov. 20, 1998 | (GB) | 9825334 |

(51) Int. Cl.[7] ..... A47K 10/24
(52) U.S. Cl. ..... 221/45; 206/554
(58) Field of Search ..... 221/33, 45, 47, 221/63, 52, 55, 303; 206/554, 812

(56) References Cited

U.S. PATENT DOCUMENTS

| | | | | |
|---|---|---|---|---|
| 3,607,521 A | | 9/1971 | Suominen | |
| 3,352,411 A | | 11/1971 | Schwarzkopf | |
| 3,729,361 A | | 4/1973 | Westlake Jr. | |
| 3,966,524 A | | 6/1976 | Lehmacher | |
| 4,062,170 A | | 12/1977 | Orem | |
| 4,759,742 A | | 7/1988 | Achelpohl | |
| 5,509,570 A | * | 4/1996 | DeMatteis | 221/33 |
| 6,155,480 A | * | 12/2000 | Botsford et al. | 229/122.1 |

FOREIGN PATENT DOCUMENTS

| | | |
|---|---|---|
| EP | 0323808 | 7/1989 |
| GB | 2299068 | 9/1996 |
| GB | 2274098 | 7/1998 |

* cited by examiner

*Primary Examiner*—Kenneth W. Noland
(74) *Attorney, Agent, or Firm*—Barnes & Thornburg

(57) ABSTRACT

A pre-formed bags dispenser comprises a container (1) having an access aperture (8), a stack (9) of pre-formed bags (10) located in the container and having a first portion (12) deviated, preferably folded, at a transverse bend (11) from a second portion (13) containing mouth ends (18) of the bags, and attachment means (20) in the container separably attached to the mouth ends (18) at lines of weakening (22), e.g. perforations. Front walls (15) of the bags at the second portion (13), tensioned by the bending of the stack, are presented towards the access aperture (8). The bag nearest to the access aperture can be drawn out through the aperture by pulling its front wall, with one hand, relative to the attachment means. As the bag is so pulled its mouth is opened and the separable attachment to the attachment means is released. The attachment means, in one form, comprises a bar block separably joined to the mouths and/or handles of the bags. The container may be in the form of a box substantially closed apart from the access aperture, a tray or a bag.

31 Claims, 6 Drawing Sheets

PRE-FORMED BAG DISPENSER AND BAGS THEREFOR

CROSS-REFERENCES TO RELATED APPLICATIONS

This application is a U.S. national application of international application serial No. PCT/GB98/03763 filed Dec. 15, 1998, which claims priority to United Kingdom serial Nos. 9726464.2, 9806242.5, 9806484.3, 9807210.1, and 9825334.7 filed Dec. 16, 1997, Mar. 25, 1998, Mar. 27, 1998, Apr. 4, 1998, and Nov. 20, 1998 (respectively).

This invention relates to a pre-formed bags dispenser and bags therefor, the dispenser being of the kind in which a stack of pre-formed bags is located to be dispensed therefrom.

Dispensers of the kind referred to and the pre-formed bags are commonly used, for example, in stores, supermarkets and other outlets for goods for the bags to be used for packaging of the goods. They may also be used in other places for the bags to be used for packaging and storing articles of various kinds.

There is a need for the bags to be readily removable from the dispensers and opened for filling. The present invention is aimed at meeting that need.

According to a first aspect, the present invention consists in a pre-formed bags dispenser comprising a container and located therein a stack of pre-formed bags and attachment means, the container having an access aperture, the bags of the stack each having a flattened body which is formed with opposed front and back walls lying together and has a closed base end and an opposite mouth end, and the bags being retained together in the stack by separable attachment at their mouth ends to the attachment means at lines of weakening, the stack having a transverse bend intermediate the base and mouth ends of the bags whereby a first portion of the stack containing the base ends is deviated from a second portion of the stack containing the mouth ends in a direction towards which external surfaces of the back walls of the bags face, and the front walls of the bags at the second portion are tensioned and presented towards the access aperture for the bag nearest to the aperture to be drawn out through the aperture by manual pulling of the front wall relative to the attachment means, and the separable attachment of the bags to the attachment means allowing separation of the bag so pulled from the attachment means in a progressive action which opens the mouth of the bag.

The pre-formed bags may be made of plastics sheet material and may be so made in a known manner. By having the bags made of plastics sheet material and held in a stack, friction between surfaces of adjacent bags in the stack, resulting from static electricity at the surfaces, creates a significant drag effect on the adjacent bag when the bag nearest to the access aperture in the container is drawn out through the aperture. The drag enables the front wall of the bag being drawn to slide relatively freely with respect to the back wall of that bag, which facilitates the opening of the mouth of the bag. This applies to each successive bag presented to be nearest the opening.

Preferably the stack is folded about the transverse bend so that the second portion is superimposed on the first portion in the container. This reduces the overall size of the stack, and hence the size of the container to hold the stack, but additionally there is the result that when a bag is being drawn through the access aperture, the part of that bag which is at the first portion of the stack is subjected to resistance to movement as the front wall of the bag is pulled, which adds to the tensioning of the front wall. This tension helps with the opening of the mouth of the bag and the resistance to movement inhibits separation of more than one bag from the stack at a time.

For use of the dispenser the container may be disposed substantially horizontally with the access aperture directed upwards. In this arrangement the weight of the second portion of the stack may be exerted on the first portion when the stack is folded as just described, which adds further to the resistance to movement of the part of the drawn bag which is at the first portion of the stack. The resistance to movement, nevertheless, can be overcome without excessive effort by the person drawing the bag from the container so as to separate the bag completely from the stack.

Whilst the folded form of the stack is preferred, the first portion may be deviated to a lesser extent about the transverse bend away from the second portion. This can still afford useful resistance to movement of the parts of the bags at the first portion which assists in the opening of the mouths of the bags as they are drawn out through the access aperture, and inhibits separation of more than one bag at a time from the stack.

Adjacent bags in the stack may be locally connected together at their bodies adjacent to their mouth ends, for example by adhesive, welding or other bonding, in a manner which enables the connection to be released between the drawn bag and adjacent bag during the action of drawing the bag through the access aperture.

The bags may be formed with or without handles at their mouth ends. If they have handles, the handles may be separably attached to the attachment means. The separable attachment of the bags to the attachment means may then be at the handles alone or at the handles and mouths of the bags.

The attachment means may comprise a bar block of the material of the bags separably attached to the mouth ends of the bodies of the bags. If the bags have handles, the bar block may be separably attached to the mouths of the bodies and/or to the handles. When attached to the mouth ends and handles the bar block may be a T-bar block, the cross part of the T extending between, and being joined to, the handles, and the stem part of the T being joined to the mouths intermediate the handles.

Alternatively the attachment means may comprise projections on, and integral with, the mouth ends of the bags. The projections may be at the mouths and/or the handles of the bags.

Yet a further possibility is for the attachment means to comprise a combination of a bar block and projections at the mouth ends of the bags.

In an embodiment in which the bags each have parallel handles integral with the body extending from opposite extremities of the mouth end, the attachment means may comprise a T-bar block, the handles and mouth of the body of each bag being separably joined to the T-bar block, the handles at opposite ends of a cross bar part and the mouth at an intermediate region to a stem part, and the closed base end of the bag having separably joined thereto a tab which is located with respect to the stem part of the T-bar block when the stack is folded at the bend.

The tabs of the bags may be located with respect to the stem part of the T-bar block in various ways. For example, the tabs may be adhesively bonded, hot pin attached or welded to the stem part, or may be attached to a pin or other retainer, or by string, at the stem part.

The T-bar block serves to hold the bags securely at their handles and mouth ends and restrain the bodies of the bags from sagging at the mouths. Location of the base ends of the bags at the stem part of the T-bar block by the tabs restrains the base ends from unintentional movement. This enables a stack to be retained in a neat state in the container of the dispenser.

Preferably the tabs are separably joined to the base ends of the bags by lines of weakening.

The lines of weakening providing the separable attachment of the bags to the attachment means, and at the tabs, may be formed conveniently by lines of perforations.

Drawing of a bag from the container through the access aperture may be done by pinching and pulling the front wall of the bag relative to the attachment means. A user may do this readily with one hand. As the mouth of the bag is opened in the action of drawing the bag through the aperture, it will be understood that the single-handed action required makes the removal and opening of the bag a simple operation to perform.

Whether the bags have or do not have handles, the sliding movement described earlier of the front wall of a drawn bag with respect to the back wall of the bag creates a peeling effect in opening the mouth of the bag. By this effect, the part of the mouth nearest to where the front wall of the bag is pulled opens initially and the opening action spreads along the mouth away from that part. As the mouth opens the front wall is drawn away from the back wall, which maintains contact with the front wall of the next bag in the stack until the final stages of separation of the drawn bag from the attachment means.

The access aperture of the container may restrict access to the front wall of the bag nearest to the aperture to an area of the front wall near to the mouth of the bag. However, it is generally more convenient, for ease of access to, and drawing out of, the bag, for the access aperture to extend from adjacent to the mouth of the nearest bag to the bend in the stack. Thus the bag may be pulled at any part of the front wall between the mouth and the bend, or even at the bend. In this case the access aperture may be enlarged at or towards the bend. Preferably, the width, position and length of the aperture, at least for the most part of the aperture, restrict access to three extended fingers and thumb of one hand of a grown person so as to deter the person from grasping any but the bag nearest to the access aperture.

The access aperture may leave the attachment means unexposed, or substantially so, in the container. Thus the access aperture may end at or near the mouths of the bags of the stack. When the bags of the stack have handles at their mouth ends, the access aperture may have an edge, which may be rigid, or at which a restraint is provided, positioned to deter a person from putting his or her hand into the container between the handles.

An indicator may be provided on the container at or adjacent to the access aperture to indicate to a user where access is to be gained to the stack for drawing a bag from the stack.

The container may be of a generally box or tray-like form having a front part in which is the access aperture. In a box form, the container may be defined as a cartridge which is substantially closed except for the access aperture. In a tray-like form, the periphery of the aperture may be defined by a marginal portion around the open side of the tray.

The container may be made to be disposed of when once the stack has been fully dispensed from it, or it may be made to be re-usable, being filled with another stack of bags when the original stack has been dispensed. It may be made of any suitable material, for example cardboard, plastics or metal, or a combination of materials. At least when made of cardboard, the container may be formed from a single integral sheet cut and having fold lines defined in it for the container to be folded into its finished shape.

In one embodiment of the dispenser the container is of a generally box-like form having opposite ends and sides and opposed front and back walls in the front one of which the access aperture is provided. The stack of bags located in the container has the attachment means held captive in the container at or adjacent to one of the opposite ends. The attachment means may comprise a bar block or a lug or lugs separably attached to the bags in the stack. In the lug or lugs form, the or each lug at each bag may be separable, as the bag is drawn out through the access aperture, from a further component of the attachment means held captive in the container.

The stack may be folded on a support inside the container. The support may be of a plate, or generally plate-like, form in which there is an opening. The stack may be held captive to the support, within the container, at one end part of the support and extend from that end part along the support to the opening where it is then passed through the opening and folded back along the support, so that the bend of the stack is in the opening. Preferably the support is removable from the container for the stack to be loaded onto it, and, if desired, for replacement stacks to be located onto the support as a stack is fully dispensed from the container. The support may be slidable into and out of the container. It may have a handle for ease of manoeuvring it relative to the container. When the stack is loaded onto the support outside the container it may be retained to the support at the attachment means, be laid along one surface of the support and fed through the opening in the support. As the support is subsequently inserted into the container the part of the stack that has been fed through the opening is caused to be folded back against an opposite surface of the support to form the first portion of the stack.

Instead of a generally box or tray-like form, as mentioned, the container may be a bag, for example of plastics sheet material, which has the access aperture in a frontal part.

Retention means may be provided at the container which is engaged with the attachment means and anchored to the container to hold the attachment means captive in the container. For example, in the generally box or tray form of the container, and when the attachment means comprises a bar block, the retention means may comprise a header part of the container which is folded around the bar block, or a part thereof, to hold the bar block captive in the container. An integral portion of the material of which the box or tray is made may define the header part. In another form the retention means may comprise a pin or pins passed through the attachment means and anchored to a wall or walls of the container. A pin may also engage in holes in the tabs which may be provided at the base ends of the bags to locate the tabs with respect to the stem part of the T-bar block example of attachment means referred to above.

In yet another form the retention means may comprise an anchorage element, for example a block, fixed in the container and the stack may have a hole, in or adjacent to the attachment means, in which the anchorage is engaged. Other suitable forms of retention means may be provided.

The container may be mounted on a bracket or other mounting at a point of use. It may be removably and replacebly mounted on the mounting. It may be supported by the mounting in a horizontal, vertical or inclined attitude, as may be convenient for user access to the stack of bags in the container at the access aperture. The dispenser may be used without having the container mounted on a mounting. The point of use may, for example, be a check-out counter in a store or a work station.

According to a second aspect the present invention consists in a stack of bags adapted to be used in a dispenser in accordance with the first aspect of the invention herein set forth.

Embodiments of the invention will now be described, by way of example only, with reference to the accompanying drawings, in which.

Figure 1:
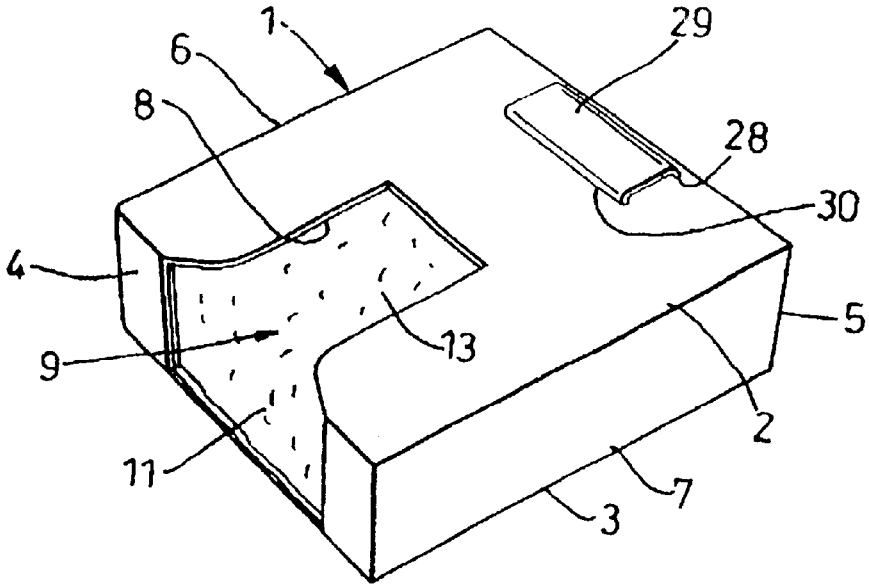
FIG. 1 is a front perspective view of a first embodiment of a dispenser according to the present invention.

In the first embodiment the dispenser comprises a container 1, FIG. 1, made of cardboard, which is of a rectangular box-like form having front and back walls 2, 3, opposed first and second end walls 4, 5 and opposed side walls 6, 7. The front wall 2 has an access aperture 8 in it. The access aperture 8 is elongated, generally rectilinear and extends centrally from about half-way along the front wall to the first end wall 4, into which the aperture extends and widens.

Figure 2:
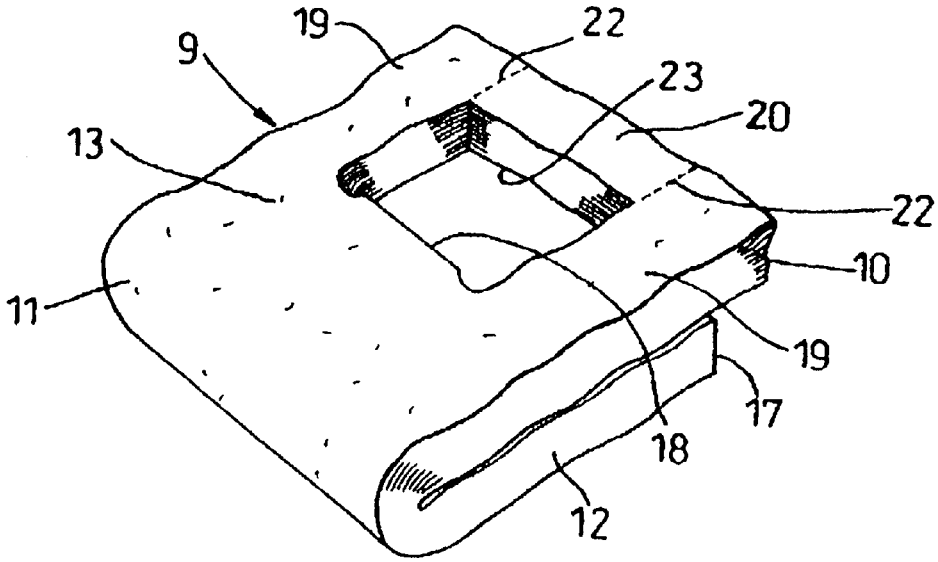
FIG. 2 is a perspective view of a stack of bags included in the dispenser.
Figure 5:
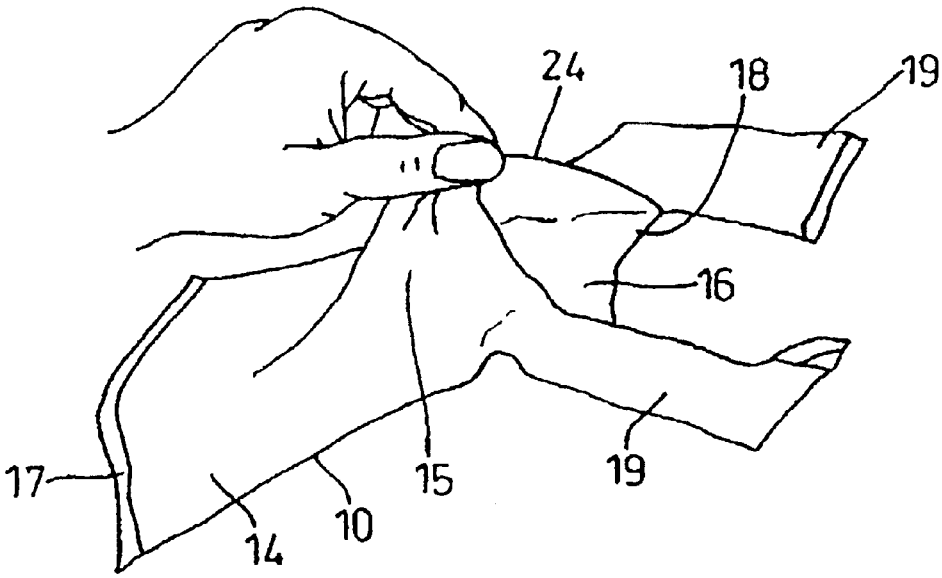
FIG. 5 is a perspective view showing a removed bag.

Located in the container 1 is a stack 9 of bags 10, FIG. 2. The bags 10 are made in known manner from plastics sheet material. They are superimposed flat upon one another and the stack 9 is folded almost in two at a transverse bend 11 so that there is a first portion 12 folded under a second portion 13. Each bag 10, as best seen in FIG. 5, has a flattened rectangular body 14 formed with a front wall 15 and back wall 16 which lie together, a closed base end 17 and an opposite mouth end 18 from opposite ends of which extend a pair of parallel handle portions 19. The handles extend from the front wall 15 to the back wall 16 and are folded in two. The base ends 17 of the bags are at the first portion 12 of the folded stack and the mouth ends 18 and handles 19 are at the second portion 13.

The bodies 14 of adjacent bags in the stack may be connected by small spots of adhesive applied centrally near the mouth ends 18 so that the bags are interconnected in daisy-chain fashion but are readily separated at the adhesive spots.

Formed as part of the stack of bags, from the same material on the bags, is an integral bar block 20, FIG. 2, forming attachment means, which extends between outer ends of the folded handles 19. The handles are attached to the bar block 20 by lines of weakening 22, defined for example by perforations. Adjacent to the bar block 20, a rectangular slot 23 is cut through the stack which defines mouths 24 at the mouth ends 18 of the bodies 14 of the bags and inside edges of the handles 19. In the folded stack, the base ends of the bags at the first portion 12 are below an intermediate region of the slot 23 and so spaced short of the bar block 20.

Figure 3:
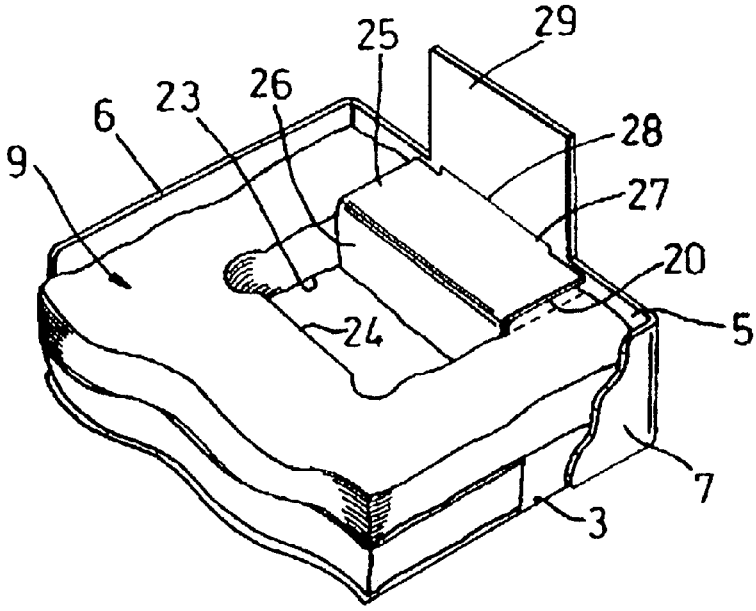
FIG. 3 is a fragmentary perspective view of the dispenser showing how the stack of bags is retained in a container thereof.

The stack 9 is positively retained in position in the container by means of a header 24, FIG. 3, which wraps around the bar block 20. The header 25 is formed from a flap 26 of material cut from, and left joined to, the back wall 3 of the container to a width corresponding to the length of the bar block between the handles 19 of the bags in the stack. The flap 26 is folded into the container, through the slot 23 in the stack and over the bar block, underneath the front wall 2 of the container. A tongue 27 at the end of the flap 26 is then threaded through slits 28 in the second end wall 5 of the container to hold the header around the bar block so that the bar block is located hard against the second end wall. The flap 26 is further held around the bar block by a security flap 29 which is an extension of the second end wall 5, folds over the end portion of the front wall 2 and is tucked through a further slit 30, in the front wall, FIG. 1, to lie against the part of the header flap 6 which extends through the slot 23 in the stack.

For ease of loading the stack in the container and applying the header 25 to the bar block, the container may be formed in two shells integrally joined together at the first end wall 4, which fit one over the other when the stack is in place. The shells respectively provide the front and back walls 2, 3 of the container and together provide the end and side walls. The security flap 29 may then serve also to secure the two shells together at the second end wall 5 by being formed as an extension of an end wall part of the shell providing the back wall 3 of the container, inserted through a second slit in the front wall 2 of the other shell adjacent to the second end wall 5, folded over the front wall and tucked into the first mentioned slit 30 in the front wall.

When the stack is in place and the container closed around it, the folded stack extends the full distance inside the container between the end walls and the full width between the side walls. The bar block 20, slot 23 and handles 19 of the bags in the stack are concealed, or substantially so, by the part of the front wall 2 of the container between the access aperture and the second end wall.

The front walls 2 of the bags at the second portion 13 of the folded stack are tensioned by the folding of the stack. An area of the front wall of the bag immediately adjacent to the front wall 2 of the container, from the mouth end 18 to the bend 11, is exposed at the access aperture. The access aperture is dimensioned to restrict access to that bag substantially to three extended fingers and a thumb of one hand of a grown person.

The folded state of the stack in the container provides a degree of resistance to movement of the parts of the bags at the first portion 12 of the stack. That resistance is enhanced by the weight of the second portion on the first portion when the container is used in a portion in which the folded stack is horizontal, or substantially so.

Figure 4:
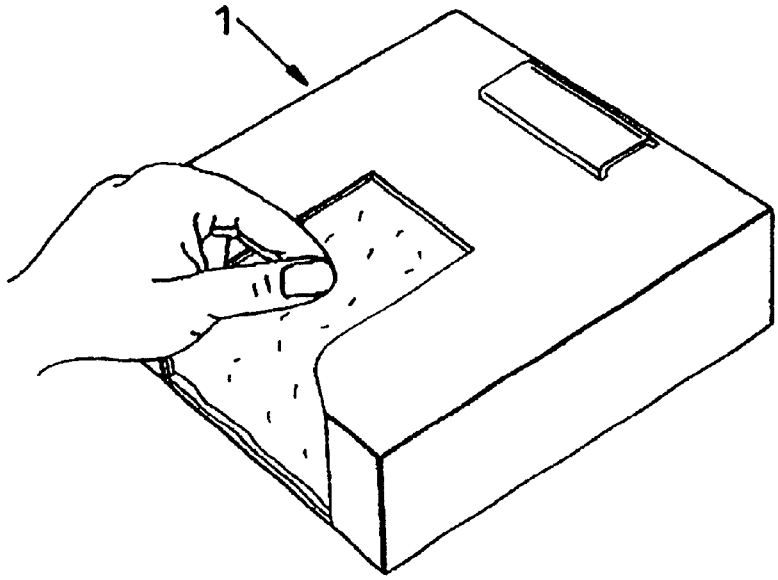
FIG. 4 is a perspective view showing how a bag in the stack may be removed from the container.

In order to remove a bag from the container, a user can pinch the exposed part of the front wall of the bag at the access aperture, as shown in FIG. 4, and pull the part out through the access aperture. As the part is pulled, the front wall of the bag separates from the back wall, sliding freely relative to that wall, which maintains contact with the front wall of the next adjacent bag in the stack with the aid of static electricity built up in the stack from the plastics material and method of manufacture of the bags. The continued pull on the front wall part opens the mouth of the bag with a peeling action which spreads from the region of the mouth nearest to the ends of the mouth and round the handles. The pull also detaches the handles from the bar block 20 at the lines of weakening 22. When the handles are detached, further pulling draws the part of the bag from the second portion of the stack out of the access aperture, and finally the rest of the bag from the first portion is detached from the stack. The fully removed bag is open at its mouth 24 and ready to be filled, as shown in FIG. 5. The whole operation can be done by a user using just one hand, and, by virtue of the size and positioning of the access aperture and the arrangement of the stack in the container, removal of more than one bag at a time is resisted.

Figure 6:
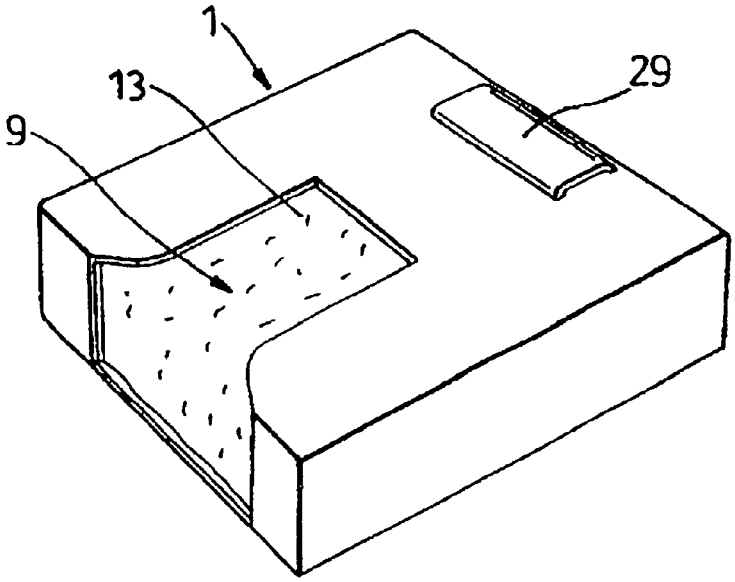
FIGS. 6 to 8 are similar to FIGS. 1 to 3 but show a second embodiment of the dispenser.
Figure 7:
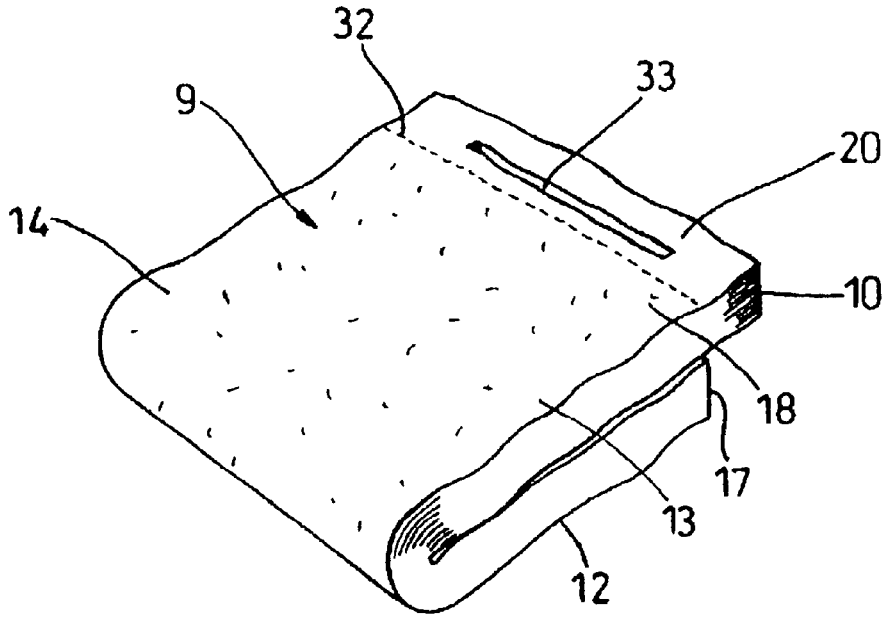
Figure 8:
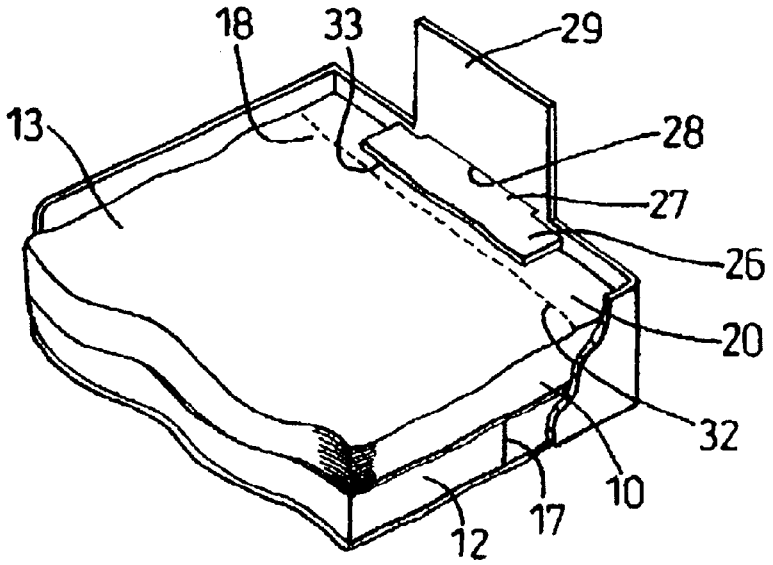

In the second embodiment, shown in FIGS. 6 to 8 of the drawings, the dispenser is largely similar to the first embodiment and corresponding parts are identified by the same reference numerals as used in the description of that embodiment. The difference lies essentially in the fact that bags 10 of the stack 9 in the container 1 have no handles, as can be seen from FIG. 7. Instead the stack has the integral bar block 2 extending across the full width of the mouth ends 18 of the bodies 14 of the bags, and the mouth ends are each separably attached to the bar block by a line of weakening 32 extending all along the length of the mouth end. A narrow slot 33 is formed through the bar block, parallel to the mouth ends, for the greater part of its length.

The stack is folded so that the base ends 17 of the bags at the first portion 12 of the stack are adjacent to the mouth ends of the bags at the second portion 13.

The container 1 is similar in all respects to that of the first embodiment. Its header flap 25, FIG. 8, is inserted through the narrow slot 33 in the bar block and folded over the bar block, and the tongue 27 is threaded, as before, through slits 28 in the second end wall of the container. The security flap 29 holds the flap 26 securely at the bar block.

Bags are removed from the container in similar manner to those of the stack in the first embodiment.

The third embodiment shown in FIGS. 9 to 12 of the drawings will now be described. Again, parts of this embodiment corresponding to parts of the first embodiment are identified by the same reference numerals.

The container 1 is generally similar to those of the first and second embodiments except that it does not have a header or security flap.

Figure 10:
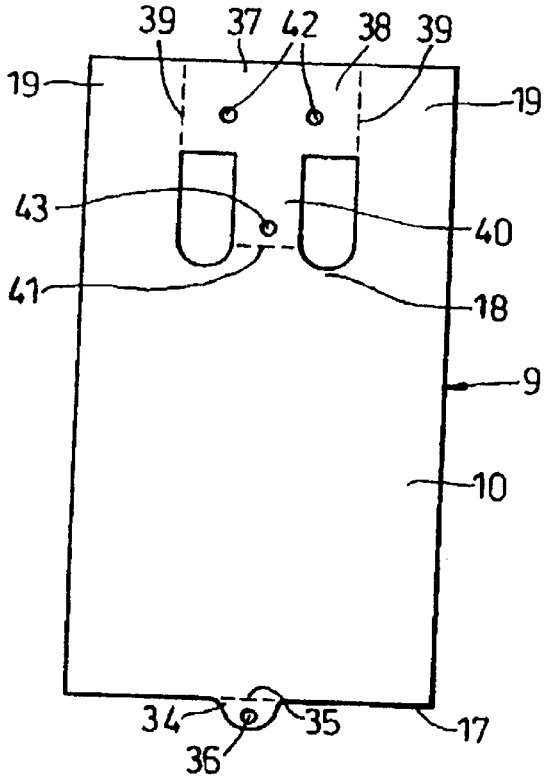
FIG. 10 shows a front elevational view of an unfolded stack of bags included in the dispenser of FIG. 9.

The stack 9 of bags 10 is basically similar to that of the first embodiment but differs in three respects. Firstly, as best seen in FIG. 10, the base ends 17 of the bags each have a small central integral tab 34 projecting from it and joined to it at a line of weakening 35, conveniently formed by perforations. There is a hole 36 in the tab 34. Secondly, a T-bar block 37 is formed as an integral part of the stack between the handles 19 of the bags. The T-bar block 37 has a cross part 38 which extends between and is separably joined to the handles 19 at their outer ends by lines of weakening 39. A stem part 40 is separably joined by lines of weakening 41 to central regions of the mouths of the bags. All the lines of weakening 39, 41 may be formed by perforations. Thirdly, holes 42 are pierced through the opposite ends of the cross part 38 near to the handles, and a further hole 43 is pierced through the stem part 40 near to the mouths of the bags.

Figure 11:
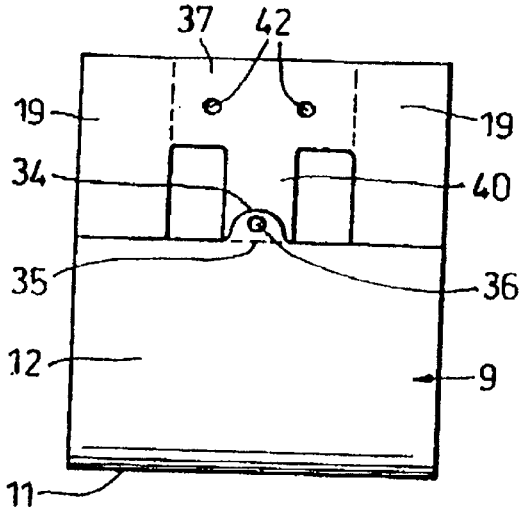
FIGS. 11 and 12 show front and side views of the stack of bags of FIG. 10 in a folded state.
Figure 12:
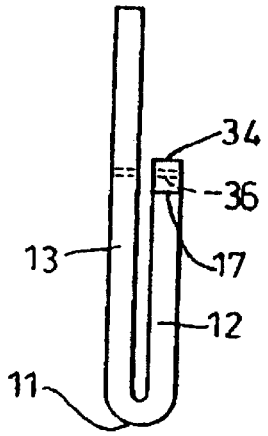
Figure 9:
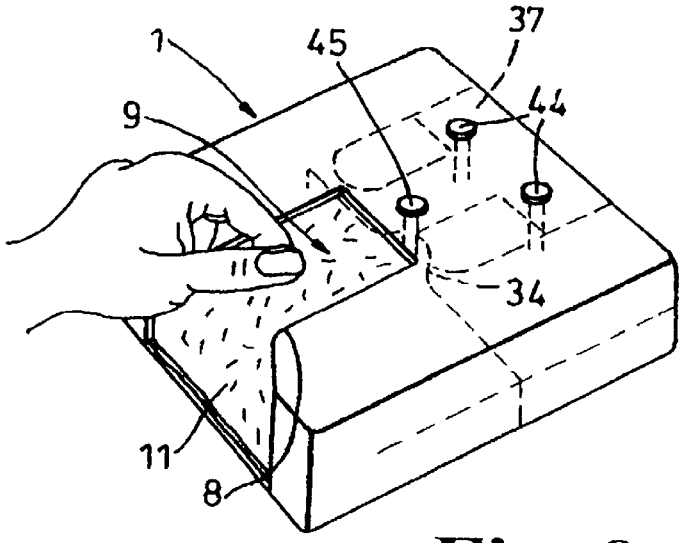
FIG. 9 shows a perspective view of a third embodiment of the dispenser.

The stack is folded about a transverse bend 11, as shown in FIGS. 11 and 12, so that the tabs 34, now at the first portions 12 of the stack, are adjacent to the stem part 40 of the T-bar block 37 with their holes 36 in register with the through holes 43 in the stem part.

The folded stack is positioned in the container similarly to the stacks in the previously described embodiments. However, the T-bar block 37 is located in the container by headed retaining pins 44, 45. Two of the retaining pins 44 are passed through the holes 42 in the cross part 38 and engaged in registering holes, not shown, in the front and back walls of the container. The third retaining pin 45 is passed through the hole 43 in the stem part 40 and the holes 36 in the tabs 34 of the bags, and is engaged in registering holes, not shown, also in the front and back walls of the container. Retainers, not shown, are attached outside the back wall to the ends of the pins 44, 45 to hold the pins securely in place and fix the T-bar block 37 rigidly in the container. The engagement of the third pin 45 in the holes of the tabs and the stem part of the T-bar block retains the base ends of the bags to the stem part and hence the stack is held securely in the folded state in the container.

Removal of a bag from the container is in the manner previously described. The base end 17 of the drawn bag separates at the line of weakening 35 from its tab 34 in the latter stages of drawing the bag out through the access aperture 8, thereby freeing the bag completely from the stack for withdrawal from the container. The detached tab remains attached to the third pin.

The other bags of the stack are left neatly folded in the dispenser. This is ensured by the fixed tabs at the third pin 45, and the secure retention of the T-bar block in the dispenser by the three pins. The mouths of the bags in the stack are held closed until the bags are in turn pinched and pulled out of the container.

When all the bags have been withdrawn from the container, the T-bar block and tabs remaining in the container may be removed from the container by release of the pins. A replacement stack of bags may then be inserted into the container and secured by the pins, or the container may be discarded.

Figure 13:
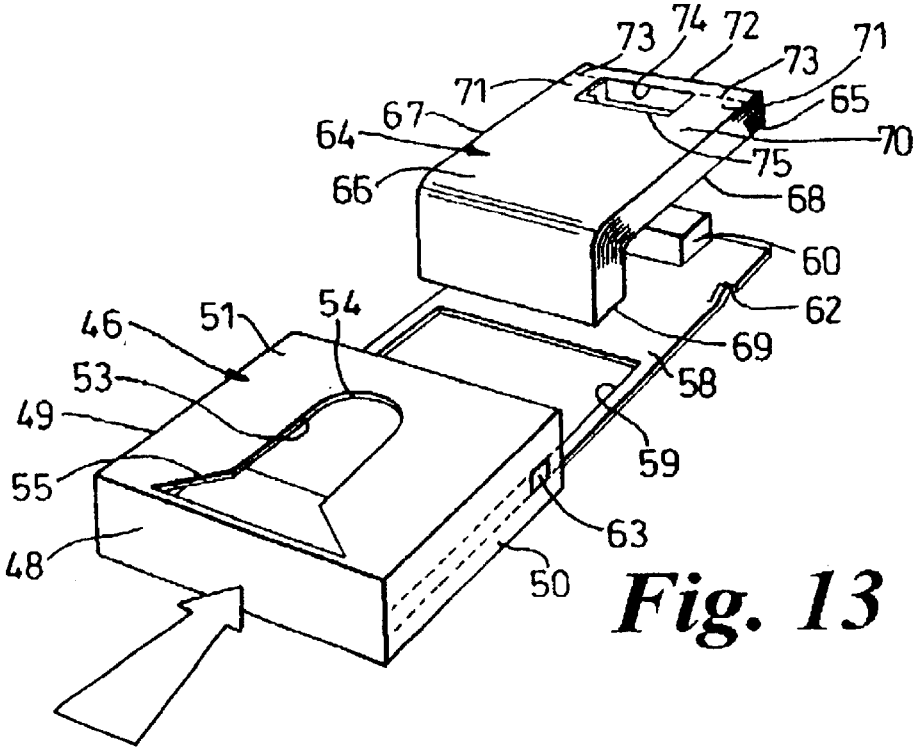
FIG. 13 is an exploded front perspective view of a fourth embodiment of the dispenser.
Figure 14:
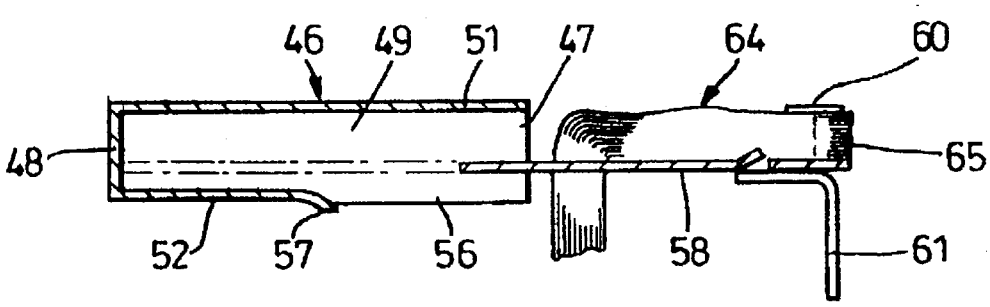
FIG. 14 is a section through the dispenser of FIG. 13 in an open position.
Figure 15:
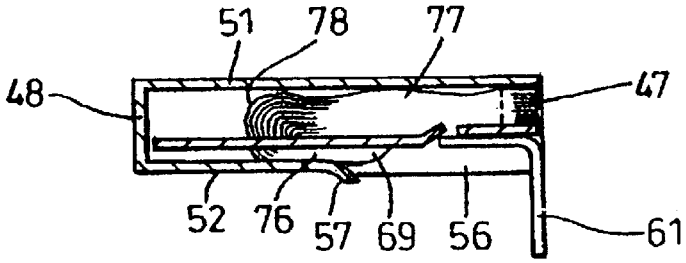
FIG. 15 is a section through the dispenser in a closed position.

In the fourth embodiment, shown in FIGS. 13 to 15, the dispenser has a container 46 in the form of a rectangular box-like cover having an open end 47, an opposite closed base end 48, opposite closed sides 49, 50 and front and back walls 51, 52. The front wall 51 contains an access aperture 53 which is elongated with a rounded end 54 towards the open end 47 of the container, parallel sided from that end for the greater part of its length and then is flared, 55, at its opposite end adjacent to the closed end 48 of the container. The back wall 52 is foreshortened towards the open end 47 leaving a gap 56, FIGS. 14 and 15, between the open end and a free end 57 of the back wall which is outwardly curved.

Slidable in the container 46 is a support 58 in the form of an oblong flat plate having a rectangular opening 59 in one half of its length. Near the end of the other half of its length the supports 58 has a locating block 60 fixed on its one surface, parallel to the end edge of the support. An L-shaped handle 61 is fixed on the opposite surface of the support 58 at the same end. Notches 62, FIG. 13, are formed near to that end.

Catches 63 are provided in the sides 49, 50 of the container which snap into engagement with the notches 62, so as to retain the support 58 positively in the container 46, when the support is slid fully into the container.

The container and support may be made of cardboard. Other suitable material may be used and the material of the one may differ from that of the other.

Supported on the support 58 is a stack 64 of bags 65. The bags 65 are substantially similar to those of the stack in the first embodiment, each having a body 66 with front and back walls 67, 68, a closed base end 69 and a mouth end 70 at which are parallel handles 71. A bar block 72, formed integrally with the stack, spans and extends across the outer ends of the handles 71, to which it is separably joined by lines of weakening 73, for example perforations. Adjacent to the bar block 72, a rectangular slot 74 is formed through the stack which defines mouths 75 and the handles 71 of the bags. The slot 74 is of complementary size and shape to the locating block 60 on the support 58.

In order to load the stack on the supports 58, the support is slid out of the container 46, at the open end 47. The stack is offered to the support so that the slot 74 is engaged by the locating block 60, and the stack is laid on the support for its opposite, free, end containing the base ends 69 of the bags, to pass, and hang, through the opening 59, as shown in FIG. 14. The support is then inserted into the open end of the container, the opposite end of the support from the locating block 60 leading into the enclosure, and the part of the stack extending on the support from the locating block to the opening 59 being towards the front wall 51 of the container. As the support is slid into the container, the free end of the stack meets the curved free end 57 of the back wall 52 of the container, which causes the free end of the stack to be folded back against the support, as shown in FIG. 15, without snagging or catching of the bags. When the support is fully received into the container, the stack is folded into a generally U-shape. The catches 63 snap into the notches 62 to hold the support securely closed in the enclosure. As in the other embodiments, therefore, the folded stack has a first portion 76, containing the closed base ends 69, and a second portion 77, containing the mouth ends 70, meeting at a transverse bend 78 in the stack, which is in the opening 59 of the support. The front walls 67 of the bags at the second portion of the stack are tensioned by the folding of the stack.

When the support 58 is fully received into the container, the second portion 77 of the stack between the locating block 60 and the opening 59 is exposed in the access aperture 53 at the front wall 51 of the container. The stack is securely located on the support by the locating block, and by its folding in the container. The bar block is concealed within the container.

A bag is removed from the stack in the container at the access aperture in the same manner as the bags in the other embodiments described. The handles of the bag separate from the bar block at the lines of weakening 73, and the mouth 75 of the bag is opened as the bag is drawn out through the access aperture.

The support can be readily removed from the enclosure, when the catches 63 have been released, for a new stack to be loaded onto it for replenishing the dispenser, as required.

What is claimed is:

1. A pre-formed bags dispenser comprising a container and located therein a stack of pre-formed bags and attachment means, the container having an access aperture, the bags of the stack each having a flattened body which is formed with opposed front and back walls lying together and has a closed base end and an opposite mouth end, and the bags being retained together in the stack by separable attachment at their mouth ends to the attachment means at lines of weakening, the stack having a transverse bend intermediate the base and mouth ends of the bags whereby a first portion of the stack containing the base ends is deviated from a second portion of the stack containing the mouth ends in a direction towards which external surfaces of the back walls of the bags face, and a portion of the front walls of the bags at the second portion are tensioned and presented towards the access aperture such that the bag nearest to the aperture has exposed a portion of its front wall which extends from adjacent the mouth end towards the bend for that body to be drawn out through the aperture by manual pulling of the front wall relative to the attachment means, and the separable attachment of the bags to the attachment menas allows separation of the bag so pulled from the attachment means in a progressive action which opens the mouth of the bag, wherein the bags of the stack are formed with handles at their mouth ends, the mouth ends of the bags being separably attached to the attachment means at the handles and the mouth ends of the bags are also separably attached to the attachment means at the mouths of the bags and in that the attachment means is spaced from the mouths of the bags so as to define a gap between the attachment means and the mouths of the bags.

2. A pre-formed bags dispenser according to claim 1 wherein the stack is folded about the transverse bend so that the second portion is superimposed on the first portion in the container.

3. A pre-formed bags dispenser according to claim 1 wherein the attachment means is formed integrally with the stack, of the material of the bags of the stack.

4. A pre-formed bags dispenser according to claim 1 wherein the attachment means comprises a bar block of the material of the bags separably attached to the mouth ends of the bags.

5. A pre-formed bags dispenser according to claim 4 wherein the bar block is a T-bar block, the cross part of the T extending between and being joined to the mouths of the bags intermediate the handles.

6. A pre-formed bags dispenser according to claim 3 wherein the attachment means comprises projections on the mouth ends of the bags.

7. A pre-formed bags dispenser according to claim 3 wherein the attachment means comprises a combination of a bar block and projections at the mouth ends of the bags.

8. A pre-formed bags dispenser according to claim 5 wherein the base end of each bag of the folded stack has separably joined thereto a tab which is located with respect to the stem part of the T-bar block.

9. A pre-formed bags dispenser according to claim 8 wherein the tabs are attached to the stem part of the T-bar block.

10. A pre-formed bags dispenser according to claim 9 wherein the tabs are attached to the stem part by means of a pin passed through holes in the tabs.

11. A pre-formed bags dispenser according to claim 8 wherein the tabs are separably joined to the base ends by lines of weakening.

12. A pre-formed bags dispenser according to claim 1 wherein the access aperture is positioned and dimensioned for he nearest bag of the stack, at the second portion of the stack, to be exposed from adjacent to the mouth of the bag to the bend.

13. A pre-formed bags dispenser according to claim 12 wherein the access aperture extends around the bend of the stack.

14. A pre-formed bags dispenser according to claim 12 wherein the access aperture is enlarged at or towards the bend.

15. A pre-formed bags dispenser according to claim 1 wherein the access aperture is positioned and dimensioned, at least for the most part, for access into the container to the bag of the stack nearest to the aperture to be restricted to three extended fingers and thumb of one hand of a grown person.

16. A pre-formed bags dispenser according to claim 1 wherein the access aperture has an edge positioned to deter a person from putting his or her hand into the container between the handles of the bags of the stack.

17. A pre-formed bags dispenser according to claim 1 wherein the access aperture has an edge at which a restraint is provided positioned to deter a person from putting his or her hand into the container between the handles of the bags of the stack.

18. A pre-formed bags dispenser according to claim 1 wherein the container is of a generally box or tray-like form having a front part in which is the access aperture.

19. A pre-formed bags dispenser according to claim 18 wherein the container is of box form and is substantially closed except for the access aperture.

20. A pre-formed bags dispenser according to claim 1 wherein the container is formed from a single integral sheet of material cut and having fold lines defined therein for the container to be folded into its finished shape.

21. A pre-formed bags dispenser according to claim 17 characterized in that the container has opposite ends and sides and opposed front and back walls in the front one of which is the access aperture, and the attachment means is held captive in the container at or adjacent to one of the opposite ends.

22. A pre-formed bags dispenser according to claim 1 wherein the attachment means is held captive in the container by retention means engaged therewith and anchored to the container.

23. A pre-formed bags dispenser according to claim 22 wherein the attachment means comprises a bar block of the material of the bags separably attached to the mouth ends of the bags and the container has a header part which is folded around at least a part of the bar block and secured in the folded state to hold the bar block captive in the container.

24. A pre-formed bags dispenser according to claim 22 wherein the retention means comprises an anchorage element fixed in the container, and the stack of bags has a hole in or adjacent to the attachment means in which the anchorage element is engaged.

25. A pre-formed bags dispenser according to claim 1 wherein the stack of bags is folded on a support inside the container.

26. A pre-formed bags dispenser according to claim 25 wherein the support is of a plate or generally plate-like form in which there is an opening and the stack is held captive to the support, within the container, at an end part of the support, extends from that end part along one surface of the support to the opening, passes through the opening and is folded back along an opposite surface of the support, the bend of the stack being in the opening.

27. A pre-formed bags dispenser according to claim 26 wherein the support is slidable into and out of the container, the stack being loaded onto the support outside the container so as to extend along the one of surface of the support from said one end to the opening and pass through the opening, and the stack being caused to fold back against the opposite surface of the support as the support is inserted into the container.

28. A pre-formed bags dispenser according to claim 27 wherein the container has catches which snap into engagement with notches in the support when the stack is fully inserted into the container, thereby to retain the support in the container.

29. A pre-formed bags dispenser according to claim 1 wherein the container is a bag with the access aperture in a frontal part thereof.

30. A pre-formed bags dispenser comprising a container and located therein a stack of pre-formed bags and attachment means, the container having an access aperture, the bags of the stack each having a flattened body which is formed with the opposed front and back walls lying together and has a closed base end and an opposite mouth end, and the bags being retained together in the stack by separable attachment at their mouth ends to the attachment means at lines of weakening, and the stack having a transverse bend intermediate the base and the mouth ends of the bags whereby a first portion of the stack containing the base ends is deviated from a second portion of the stack containing the mouth ends in a direction towards which external surfaces of the back walls of the bags face, and a portion of the front walls of the bags at the second portion are tensioned and presented towards the access aperture such that the bag nearest to the aperture has exposed a portion of its front wall which extends from adjacent the mouth end towards the bend for that bag to be drawn out through the aperture by manual pulling of the front wall relative to the attachment means, and the separable attachment of the bags to the attachment means allows separation of the bag so pulled from the attachment means in a progressive action which opens the mouth of the bag, wherein the bags of the stack are formed with handles at their mouth ends, in that the attachment means comprises a bar block of the material of the bags extending between and separably attached to the handles and in that the container has a header part which is folded around at least a part of the bar block and secured in the folded state to hold the bar block captive in the container.

31. A pre-formed bags dispenser according to claim 30 wherein the container is a bag with the access aperture in a frontal part thereof.

* * * * *